United States Patent [19]

Miller et al.

[11] Patent Number: 4,600,054

[45] Date of Patent: Jul. 15, 1986

[54] TUBING HANGER ASSEMBLY

[75] Inventors: Jim Miller, Tomball; Jim Humphries, Houston; Toby Teel, Humble, all of Tex.

[73] Assignee: Equipment Renewal Company, Houston, Tex.

[21] Appl. No.: 595,552

[22] Filed: Mar. 30, 1984

[51] Int. Cl.[4] ..... E21B 33/03

[52] U.S. Cl. ..... 166/75.1; 174/136; 277/121; 285/137.2

[58] Field of Search ..... 166/75 R, 75 A; 174/47, 174/136; 277/121; 285/137 A

[56] References Cited

U.S. PATENT DOCUMENTS

| | | | |
|---|---|---|---|
| 1,794,278 | 2/1931 | Carney | 174/136 |
| 2,275,019 | 3/1942 | Peterson | 174/136 |
| 3,011,804 | 12/1961 | Burns | 166/75 A |
| 3,251,161 | 5/1966 | Stirn | 174/136 |
| 3,451,481 | 6/1969 | Larmon, II | 285/137 A |
| 3,516,492 | 6/1970 | Petersen | 285/137 A |
| 4,458,903 | 7/1984 | Tohill | 166/75 A |
| 4,478,278 | 10/1984 | Klein | 166/241 |

FOREIGN PATENT DOCUMENTS

| | | | |
|---|---|---|---|
| 819498 | 9/1959 | United Kingdom | 166/75 A |

*Primary Examiner*—Stephen J. Novosad
*Assistant Examiner*—William P. Neuder
*Attorney, Agent, or Firm*—Arnold S. Cohn

[57] ABSTRACT

A segmented tube hanger utilized in supporting tubing strings having the feature of allowing the sealed passage of electrical cable thru it therefore eliminating the splicing of electrical cable and the use of multi-pronged electrical connectors by using an axially slit or axially spiralled compressible and resilient tube packing.

2 Claims, 9 Drawing Figures

TUBING HANGER ASSEMBLY

BACKGROUND OF THE INVENTION

In the production operations of low downhole pressure oil wells, it is common to utilize electric motor driven downhole pumps to augment the downhole pressure. An in-line motor driven pump is located thru the tubing in the proximity of the perforated production zone.

Prior to the invention in hand, the cable providing electricity to the motor would be routed from the downhole pump motor to the wellhead where it would terminate with a standard electrical connector. A separate segment of cable would connect above ground at the wellhead connector and be connected at a power junction box some distance from the wellhead. The invention at hand consists of a tubing hanger design which eliminates the need for an electrical connector.

An object of the invention is to provide a continous downhole cable system free of a wellhead-located electrical connector, wherein a non-spliced cable would be routed from the origination point of a downhole pump motor, thru a wellhead and be terminated at a power junction box.

A second object of the invention is to provide reliable power to the downhole pump motor by eliminating a connection in the power line.

A further object of the invention is to provide a spark free connection at the wellhead during maintenance of the wellhead.

Further, another object of the invention is to provide a novel and unique tubing hanger for existing wellheads to accept a pass thru cable without requiring redesign of standard wellheads.

Other objects and embodiments of the invention will become apparent upon the reading of the specification therein and upon the study of the various figures referred to therein.

DESCRIPTION OF THE DRAWINGS

Figure 1:
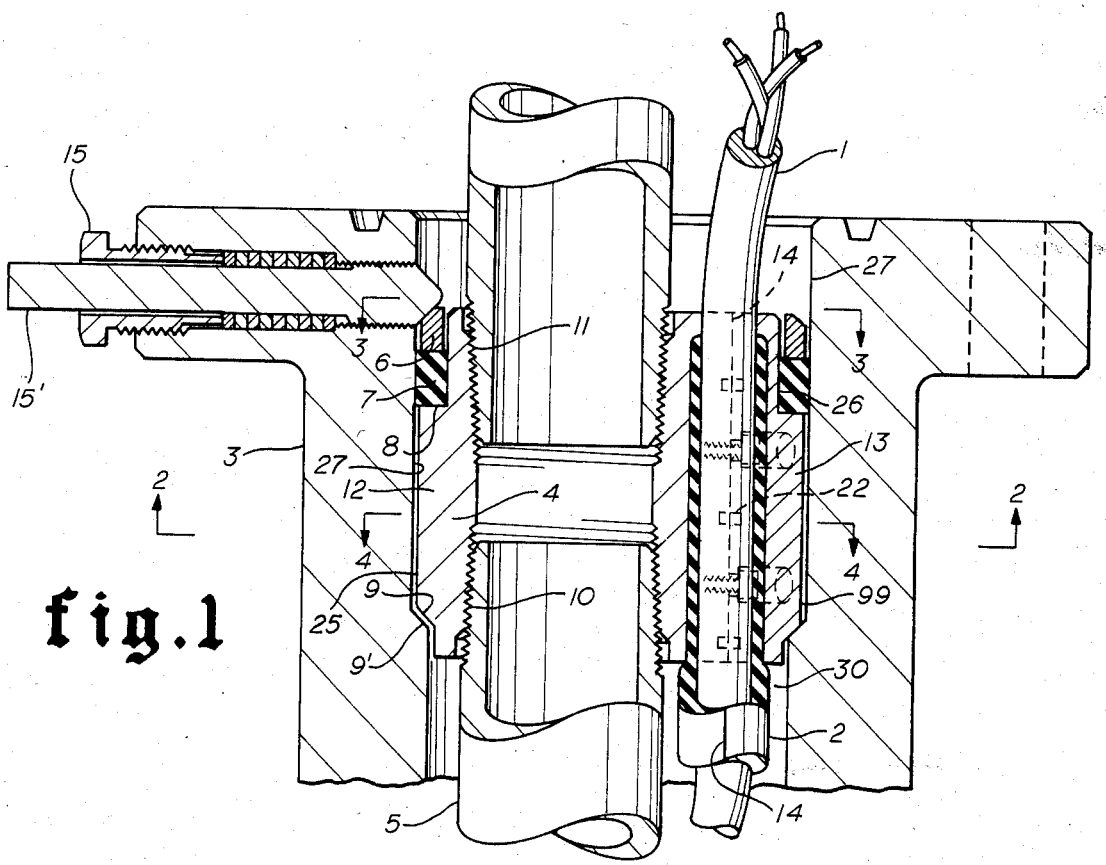
FIG. 1 is a section view of a vertical orientated wellhead disclosing a hanger, tubing and the sealed passage of an electrical power cable.

FIG. 1 is a section view of the Tubing Hanger Assembly 99. The two (2) sections of tubing 5 are supported and suspended using a tubing hanger 4 which has internally centralized pipe-type threads namely, bottom thread 10 and top thread 11. The tubing hanger 4 is supported on its downwardly facing seat 9 at an upwardly facing landing surface 9' located within a lower wellhead flange 3. A seal of any media within the annular area between the tubing 5 and the interwall of the lower wellhead flange 3 is achieved due to the great weight of the tubing 5 acting at landing 9' and packing 7 in place at the uppermost position of the tubing hanger 4 and interwall of the lower wellhead flange 3. A circular ring 6 holds a packing 7 in place restraining any movement of packing 7. Through the use of a lock down screw and packing assembly 15 and lock down screw 15', the ring 6 is held in its place.

The tubing hanger 4 is a standard shaped tubing hanger. It is circular in shape having its lower end chamfered between stepped diametrical surfaces. This chamfered surface is the seat 9 in the instant invention. Only one tubing string is illustrated in FIG. 1; however, in practice many wells use multiple tubing strings and therefore a multiple tubing type hanger would be utilized having the same design features as illustrated and described herein.

The outside diameter 25 of the tubing hanger 4 is turned over the majority of length of the said tubing hanger 4. It is slightly smaller than the internal bore 27 of the lower wellhead flange 3. At the upper end of the said tubing hanger 4 a stepped outside diameter 26 is turned. This said stepped outside diameter 26 accepts the ring 6 and the packing 7.

A cable 1 is shown located within a space 30 between the lower wellhead flange 3 and tubing 5. The routing of the said cable 1 is shown to go through a bore in the tubing hanger 4. After passing through the tubing hanger 4, the cable 1 is routed thru the wellhead. The media, if any, in the annular area between an enlarged portion of the bore in the tubing hanger 4 is sealed relative to the cable by utilizing a tube packing 2 which is wrapped around the said cable 1 at the point where the said cable 1 passes through the bore in the tubing hanger 4. The bore in the tubing hanger 4 has its center line along facing verticaly surfaces of the large sector 12 and the small sector 13 so that said tube packing 2 is compressed in between the large sector 12 and the small sector 13. A plurality of seals 22 provides sealing between the said large sector 12 and said small sector 13 and are so orientated on the interface surface 14 in a direction perpendicular or transverses to the said cable 1. At the conclusion of the assembly shown in FIG. 1, the wellhead can be so located and assembled on top of the said lower wellhead flange 3.

Figure 9:
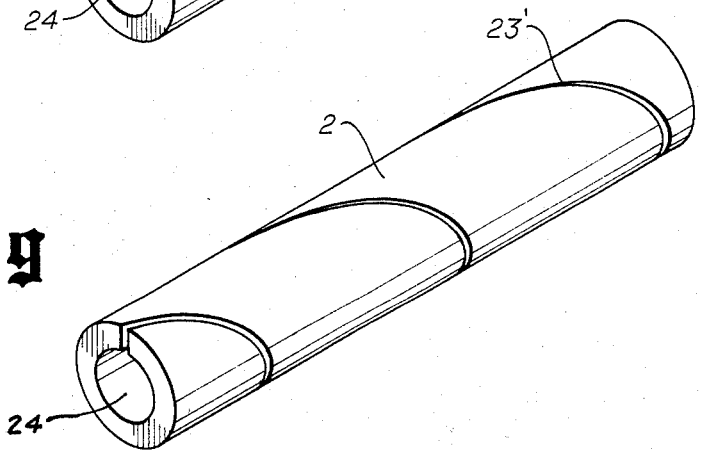
FIG. 9 is a perspective view of a spiral-cut tube packing.

The tube packing 2 is a length of resilient material having an outside diameter hole 24 over its entire length. To allow for easy assembly onto the cable 1 prior to it being compressed after the assembly of the small sector 13 and large sector 12, the said tube packing 2 is slit for its entire length or cut in a spiral manner as illustrated in FIG. 9.

Figure 2:
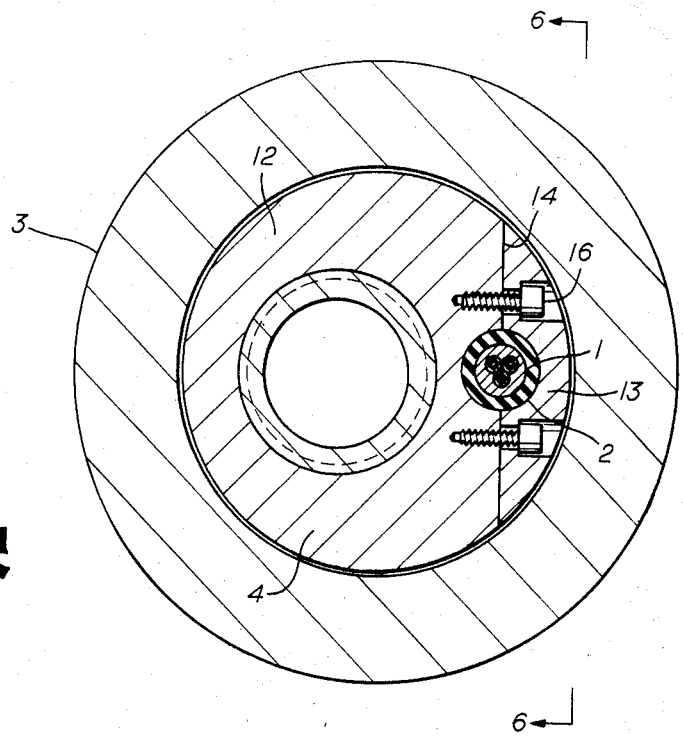
FIG. 2 is a top view looking downward at the top plane of a wellhead disclosing the orientation of the power cable passage and tubing string as located in a segmented hanger.

FIG. 2 is a section view illustrating the passage of the said wrapped cable 1 through the said tubing hanger 4. The said tubing hanger 4 is comprised of a large sector 12 and a small sector 13 which communicate along an interface surface 14. These sectors are held in place utilizing a plurality of bolts 16. The cable 1 is encased with the tube packing 2, the said tube packing 2 being in a compressive state. The said large sector 12 and said small sector 13 are assembled together with a plurality of bolts 16. The bolts are torqued properly in order to ensure the equal load distribution on the said large sector 12 and said small sector 13.

Figure 3:
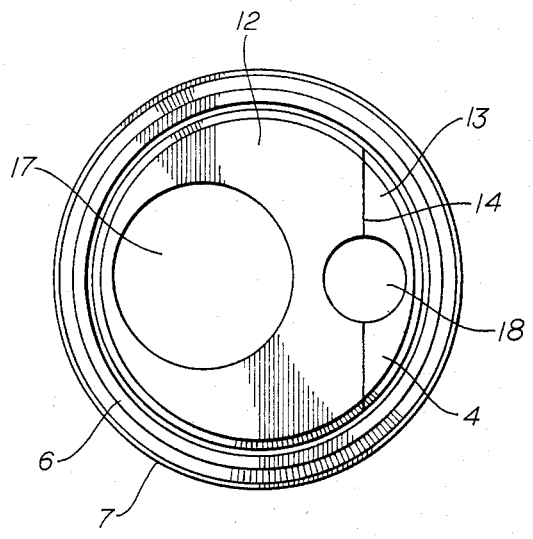
FIG. 3 is a top view looking downward at the large section and small section of the tubing hanger disclosing the interface surface between the sectors.

In FIG. 3 the large sector 12 and the small sector 13 of the said tubing hanger 4 are illustrated. The curvature of said large sector 12 and said small sector 13 have a common centerpoint. A ring 6 and a packing 7 are concentrically located with relationship of the said tubing hanger 4. A small bore 18 is centered along the interface surface 14, the diameter of the said small bore 18 is equal to or slightly greater than the cable 1 which passes through it. The tubing entry 17 is offset in the said large sector 12, it being located anywhere within the perimeter of said large sector 12.

Figure 4:
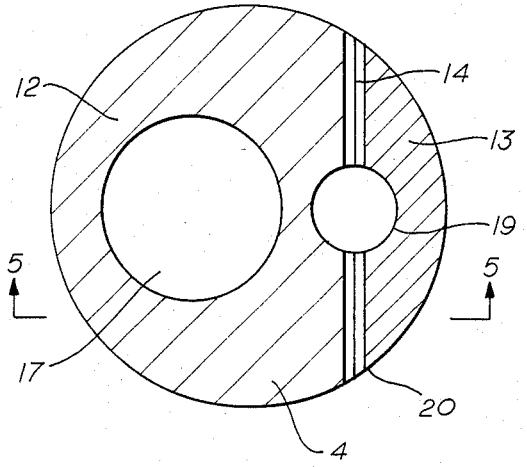
FIG. 4 is a section view of the tubing hanger cutting thru a groove wherein a seal is utilized for sealing between the sectors of the tubing hanger.

In FIG. 4 a large bore 19 is illustrated. The said large bore 19 extends axially upward from the bottom of the said tubing hanger 4 a majority length of the said tubing hanger 4 but not completely through the top of the said tubing hanger 4. A groove 20 is symmetrically located along said interface surface 14.

Figure 5:
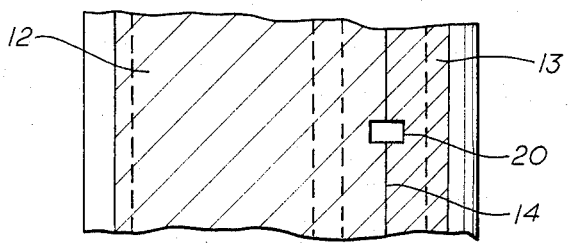
FIG. 5 is a frontal section view disclosing the rectanglar grooves which accept the seals at the interface of the two sectors.

In FIG. 5 a plurality of grooves 20 are illustrated at the said interface surface 14.

Figure 6:
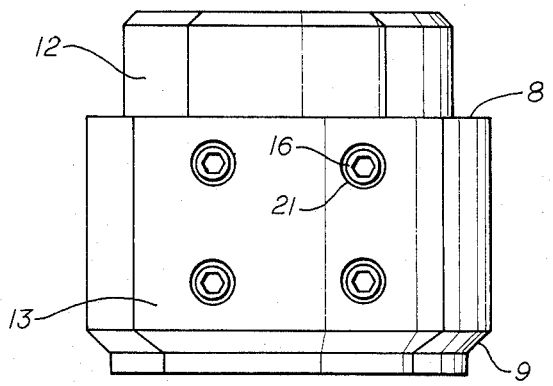
FIG. 6 is a side view of the tubing hanger which discloses the bolt pattern which maintains communication of the large and small sector of the tubing hanger.

In FIG. 6 a side view of the tubing hanger 4 is illustrated, showing the frontal view of the said small sector 13. A symmetrical bolt pattern is shown. The chamfered seat 9 area is on the underside of the said small sector 13. The shoulder 8 area is on the top side of the said small sector 13.

Figure 7:
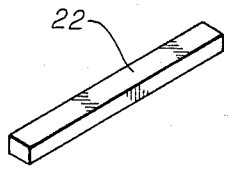
FIG. 7 is a perspective view of a seal utilized in the grooves at the interface surface of the tubing hanger sectors.

In FIG. 7 a typical square shaped seal 22 is illustrated which communicates at the interface surface 14 in said grooves 14.

Figure 8:
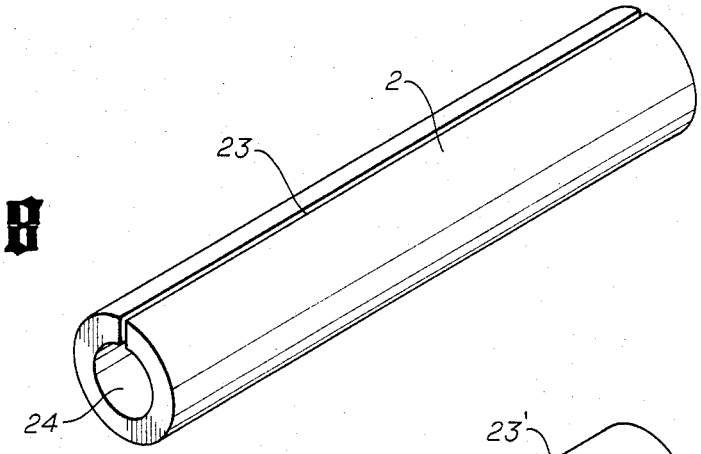
FIG. 8 is a perspective view of the cylinderically shaped tube packing.

In FIG. 8 a tube packing 2 is illustrated it having been cut axially in order that it fit over the said cable 1.

In FIG. 9 another embodiment of the tube packing 2 is illustrated it being cut in a spiral manner having spiral split line 23'.

DESCRIPTION OF THE PREFERRED EMBODIMENTS

In recognizing the objectives of the invention, a segmented tube hanger has been described herein and illustrated in the figures which permit the sealed passage of electrical cable thru a wellhead without the need of the cable to be spliced, vis-a-vis a multi-pronged electrical connector.

The tube hanger is of standardized outside shape in order that it will be accomodated by standard wellheads and standard internally beveled flanges.

The tube hanger is segmented and joined together at an interface surface, the segments being held together with a plurality of bolts. The weight of the tubing string causes the tube hanger to properly seat.

In using the tube hanger as a sealed conduit for the routing of electrical cable, the cable is first wrapped with a tube packing. The tube packing may be axially slit along its length and put in place over the cable or it may be spirally cut and then put in place over the cable. The wrapped cable is then sandwiched in the large bore located at the interface of the two segments, the tube packing abutting the juncture of the large and small bore. The hanger with its tubing attached is lowered onto the beveled internal landing of the wellhead flange, the topside continuous cable is routed thru the wellhead, the wellhead is assembled, the cable is connected at a junction box and then operations can begin.

It is intended and desired that the embodiments shown and described in detail herein shall be deemed illustrative in nature and not restrictive in order that various modifications thereof will be apparent to those skilled in the art and be applied thereto without departing from the scope of the present invention.

What we claim as being new and novel is:

1. A tubing hanger assembly for use in a wellhead flange for a production oil well where it is desired to pass an electrical cable through the tubing hanger assembly, said tubing hanger assembly including:

a cylindrically formed tubing hanger member having diametrically stepped outer surfaces for defining a downwardly facing landing seat adapted for engagement with an upwardly facing landing surface in a wellhead flange, said tubing hanger member having a central axis, said tubing hanger member being constructed of at least two sector parts which have facing vertical surfaces disposed to one side of said central axis and perpendicular to said central axis so as to form a large sector part including the central axis and a small sector part, means for interconnecting said sector parts to one another with said vertical surfaces in contact with one another, sealing means disposed transversely to said central axis when interconnected for pressure sealing of said vertical surfaces relative to one another above and below said interconnecting means, said interconnected sector parts defining a vertical bore with its axis along the said facing vertical surfaces and parallel to said central axis, said bore having a smaller diameter bore opening at the upper horrizontal surface of the tubing hanger member and a lower larger diameter bore opening at the lower horrizontal surface of the tubing hanger member, said smaller diameter bore opening being sized to the diameter of an electrical cable to be used with the tubing hanger member and said larger diameter bore opening being sized to receive a tubular sealing means, sealing means in said larger diameter bore opening for providing a sealing relationship between the larger diameter bore opening and an electrical cable, said tubing hanger member having upper diametrically stepped outer surfaces for receiving an annular sealing means, annular sealing means on said tubing hanger member at said upper diametrically stepped outer surfaces, annular compression ring means disposed above said annular sealing means for compressing said annular sealing means into a sealing relationship between said tubing hanger member and a well flange, and said large sector part having at least one production threaded bore adapted for receiving threaded ends of tubing.

2. The apparatus as set forth and defined in claim 1 wherein said sealing means in said larger diameter bore opening is a resilient tubular sleeve having a lengthwise extending cut for facilitating placement of said tubular sleeve on a cable.

* * * * *